US008469363B2

(12) United States Patent
Davis

(10) Patent No.: US 8,469,363 B2
(45) Date of Patent: Jun. 25, 2013

(54) UNDERWATER TARGET GAME

(75) Inventor: Jeffery M. Davis, Manassas, VA (US)

(73) Assignees: Jeffery M. Davis, Manassas, VA (US); Jose M. Bouza, Bumpass, VA (US)

( * ) Notice: Subject to any disclaimer, the term of this patent is extended or adjusted under 35 U.S.C. 154(b) by 170 days.

(21) Appl. No.: 12/732,544

(22) Filed: Mar. 26, 2010

(65) Prior Publication Data

US 2010/0184523 A1 Jul. 22, 2010

Related U.S. Application Data

(60) Provisional application No. 61/290,111, filed on Dec. 24, 2009.

(51) Int. Cl.
*A63B 67/00* (2006.01)

(52) U.S. Cl.
USPC ..... 273/350; 273/349

(58) Field of Classification Search
USPC .. 273/349, 350; 446/153, 155, 156; 441/1–34
See application file for complete search history.

(56) References Cited

U.S. PATENT DOCUMENTS

| | | | | | |
|---|---|---|---|---|---|
| 427,480 | A * | 5/1890 | Paine | 441/3 |
| 2,836,927 | A * | 6/1958 | Warner | 446/155 |
| 3,095,197 | A * | 6/1963 | Weitzman | 273/350 |
| 3,342,171 | A * | 9/1967 | Ryan et al. | 124/55 |
| 3,434,716 | A * | 3/1969 | Schwartz | 463/64 |
| 3,613,097 | A * | 10/1971 | Daughenbaugh | 342/10 |
| 3,652,090 | A * | 3/1972 | Semmens | 273/336 |
| 3,719,048 | A * | 3/1973 | Arne et al. | 405/205 |
| 3,755,836 | A * | 9/1973 | Milazzo | 441/22 |
| 4,034,851 | A * | 7/1977 | Barksdale | 206/77.1 |
| 4,082,063 | A * | 4/1978 | Strickland | 119/254 |
| 4,744,565 | A * | 5/1988 | Newberger | 273/342 |
| 6,092,702 | A * | 7/2000 | Cassidy, IV | 224/153 |
| 6,176,047 | B1 * | 1/2001 | Morningstar | 52/101 |
| 6,511,074 | B1 * | 1/2003 | Fireman | 273/350 |
| 7,247,077 | B1 * | 7/2007 | Arias | 446/153 |
| 7,264,420 | B2 * | 9/2007 | Chang | 405/195.1 |
| 7,775,915 | B2 * | 8/2010 | McCarthy | 473/466 |
| 2007/0074712 | A1 | 4/2007 | Fielding, Jr. | |
| 2008/0143052 | A1 * | 6/2008 | Paslawski | 273/350 |

* cited by examiner

*Primary Examiner* — Mark Graham
(74) *Attorney, Agent, or Firm* — Lowe Hauptman Ham & Berner, LLP

(57) ABSTRACT

A target for use in an underwater target game and a method of the underwater target game are described. The target comprises a body for capturing a volume of gas; and one or more target surfaces positioned to release gas from an impacting vortex ring for capture by the body. A method comprises transitioning a target positioned within a body of water to a hit indication state in response to impact on the target by a vortex ring.

15 Claims, 9 Drawing Sheets

UNDERWATER TARGET GAME

RELATED APPLICATIONS

The present application is related to prior-filed U.S. Patent Application having application Ser. No. 12/570,798 titled, "Vortex Ring Producing Gun" filed on Sep. 30, 2009 having the same inventor, the entirety of which is incorporated herein by reference. The present application is a non-provisional application claiming priority to prior-filed U.S. Provisional Patent Application having Application Ser. No. 61/290,111 titled, "Underwater Target Game" filed on Dec. 24, 2009 having the same inventor, the entirety of which is incorporated herein by reference.

BACKGROUND

Water-based, and in particular underwater-based, games are popular activities for people at or near bodies of water. Such bodies of water include ponds, lakes, pools, and even bathtubs. Different versions of time and/or non-time-based underwater retrieval games are known to the inventor.

DESCRIPTION OF THE DRAWINGS

One or more embodiments are illustrated by way of example, and not by limitation, in the figures of the accompanying drawings, wherein elements having the same reference numeral designations represent like elements throughout and wherein.

DETAILED DESCRIPTION

Figure 1:
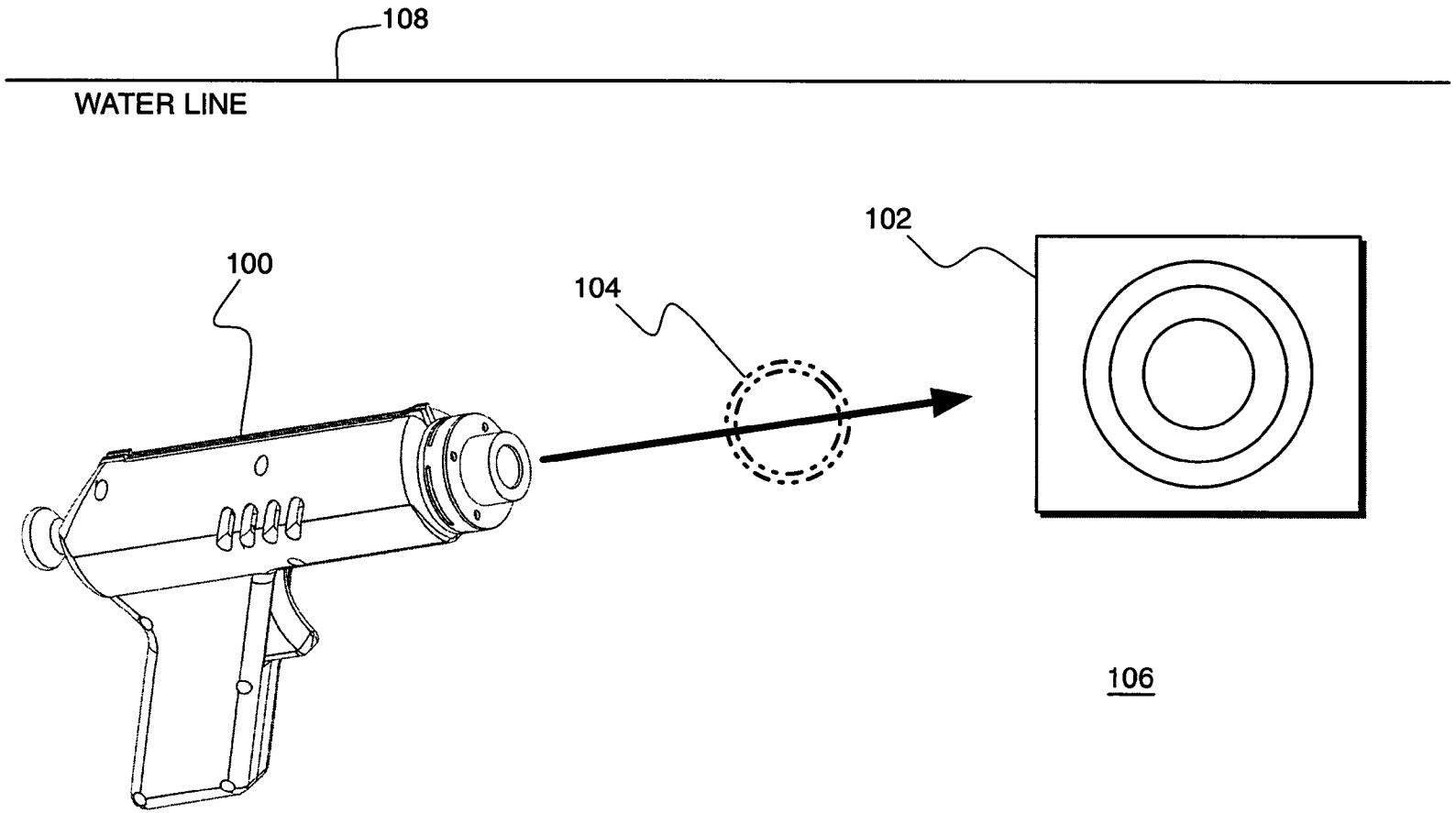
FIG. 1 is a schematic view of an underwater target game according to an embodiment.

FIG. 1 depicts a schematic view of an underwater target game according to an embodiment which comprises a vortex ring generating gun 100 and an underwater target 102. Vortex gun 100 generates and expels a vortex ring 104 toward target 102. Vortex gun 100 and target 102 are positioned within and below the surface of a body of water 106, i.e., below water line 108.

In at least some embodiments, vortex gun 100 is a vortex ring producing gun as described in U.S. patent application Ser. No. 12/570,798.

In at least some embodiments, a portion of either gun 100 or target 102 may protrude above water line 108.

In at least some embodiments, vortex ring 104 comprises a gas in addition to a moving volume of water. In at least some embodiments, the gas may be ambient air, carbon dioxide, etc.

In at least some embodiments, vortex ring 104 comprises a secondary fluid in addition to/in place of the moving volume of water. In at least some embodiments, the secondary fluid may be a colored fluid, a fluid having a predetermined specific gravity, a fluid having any specific detectable chemical composition, etc.

In accordance with a primarily force-based detection embodiment, target 102 comprises one or more surfaces configured to experience a force due to impact of the vortex ring 104 on the target. In response to the force of impact from vortex ring 104 impacting target 102, the target is transitioned to a hit indication state. In at least some embodiments, impact of vortex ring 104 causes a tipping action, a valve to open, or a latching mechanism to release, e.g., by leverage or twisting action, such that fluid enters/exits the target, gas is allowed to escape from the target, or the target is disconnected from another body, thereby releasing the target from a retained state.

In at least some embodiments, the retained state comprises target 102 as a buoyant target connected to an object or surface that causes the target to remain submerged until impact from vortex ring 104 causes disconnection from the object or surface, thereby releasing the target from the retained state. In at least some other embodiments, the retained state comprises target 102 as a non-buoyant target connected to an object or surface that causes the target to remain at some distance from the bottom of a body of water 106 until impact from vortex ring 104 causes disconnection from the object or surface, thereby releasing the target from the retained state. In at least some further embodiments, the retained state comprises target 102 as a variably buoyant target positioned within or floating upon a body of water 106 until impact from vortex ring 104 causes an increase or decrease of buoyancy, thereby releasing the target from the retained state.

In accordance with a primarily gas-based detection embodiment, impact of vortex ring 104 on one or more surfaces of target 102 causes a disruption of the vortex ring and a consequent release of the gas trapped within the ring. The released gas is detected by target 102 causing the target to transfer to a hit indication state. In at least one embodiment, target 102 comprises a cavity for collecting the released gas from the vortex ring 104 and preventing escape of the gas to the surface of the surrounding fluid, i.e., water 106. Said collected gas causes an upward buoyant force to be applied to target 102. In at least some embodiments, said cavity is aligned with a vertical line passing through the center of gravity of the target 102 such that when gas is collected in the cavity the whole target experiences a uniform upward buoyant force toward the surface of the surrounding fluid, e.g., waterline 108. In at least some other embodiments, the cavity is not vertically aligned with the center of gravity of target 102 such that when gas is collected in the cavity the target experiences a rotational buoyant force about its center of gravity. In at least some embodiments, said rotational buoyant force causes the target 102 to tip and thereby release a previously trapped quantity of buoyancy providing gas, and said loss of net buoyancy causes the target to sink.

In either of the above or other alternative embodiments, the hit indication state may be indicated by target 102 rising toward the water surface, sinking lower in the water, at least a portion of the target flipping over, at least a portion of the target spinning, at least a portion of the target moving laterally, displaying one or more numbers or letters on or through a surface of the target, or emitting sound or light. In at least some embodiments, one or more combinations of these indications may be performed by target 102.

In at least some embodiments, target 102 requires the impact of more than one vortex ring 104 in order to register a hit on the target.

In at least some embodiments, target 102 is automatically reset after registering a hit or impact of the vortex ring on the target. In at least some other embodiments, target 102 requires a manual reset after registering a hit.

In at least some embodiments, there may be more than one target 102 positioned for the user to shoot at. In accordance with such embodiments, the multiple targets may be separated from each other or attached to each other.

In at least some embodiments, one or more targets may be floating unattached or attached to a surface of the material surrounding the water, e.g. a side or bottom surface of a pool. In at least some other embodiments, one or more targets may be non-buoyant and suspended from either a buoyant device floating upon or within the water, or suspended from a device connected to, for example, the side of the pool.

In operation, one or more targets 102 are positioned within water 106. The user controls and aims the vortex gun 100 (also positioned within the water) at the target. The user then manipulates the vortex gun 100 to cause expulsion of the vortex ring 104 toward the target 102.

If the vortex ring 104 impacts the target 102, then the target transitions to a hit indication state signifying that the user has hit the target. In at least some embodiments, if the user hits the target, then the user has won. In at least some other embodiments, more than one hit of the target by the user is required in order for the user to win.

In at least some embodiments, more than one user may participate with the same or additional vortex gun(s) 100, and the same or additional target(s) 102.

In at least some embodiments, each hit of the target 102 by a vortex ring 104 causes the target to accumulate a point value based on the number of hits of the target. In at least some embodiments, the point accumulation may be carried out in conjunction with a timer mechanism associated with the target to record a number of hits over a given period of time.

In accordance with one or more embodiments, target 102 may comprise different size and/or material and/or functional configurations from those illustrated in the drawings and described in the specification and still fall within the scope and spirit of embodiments of the present invention. In particular, target 102 may comprise variations in size, materials, shape, form, function, manner of operation, assembly and use.

Figure 2:
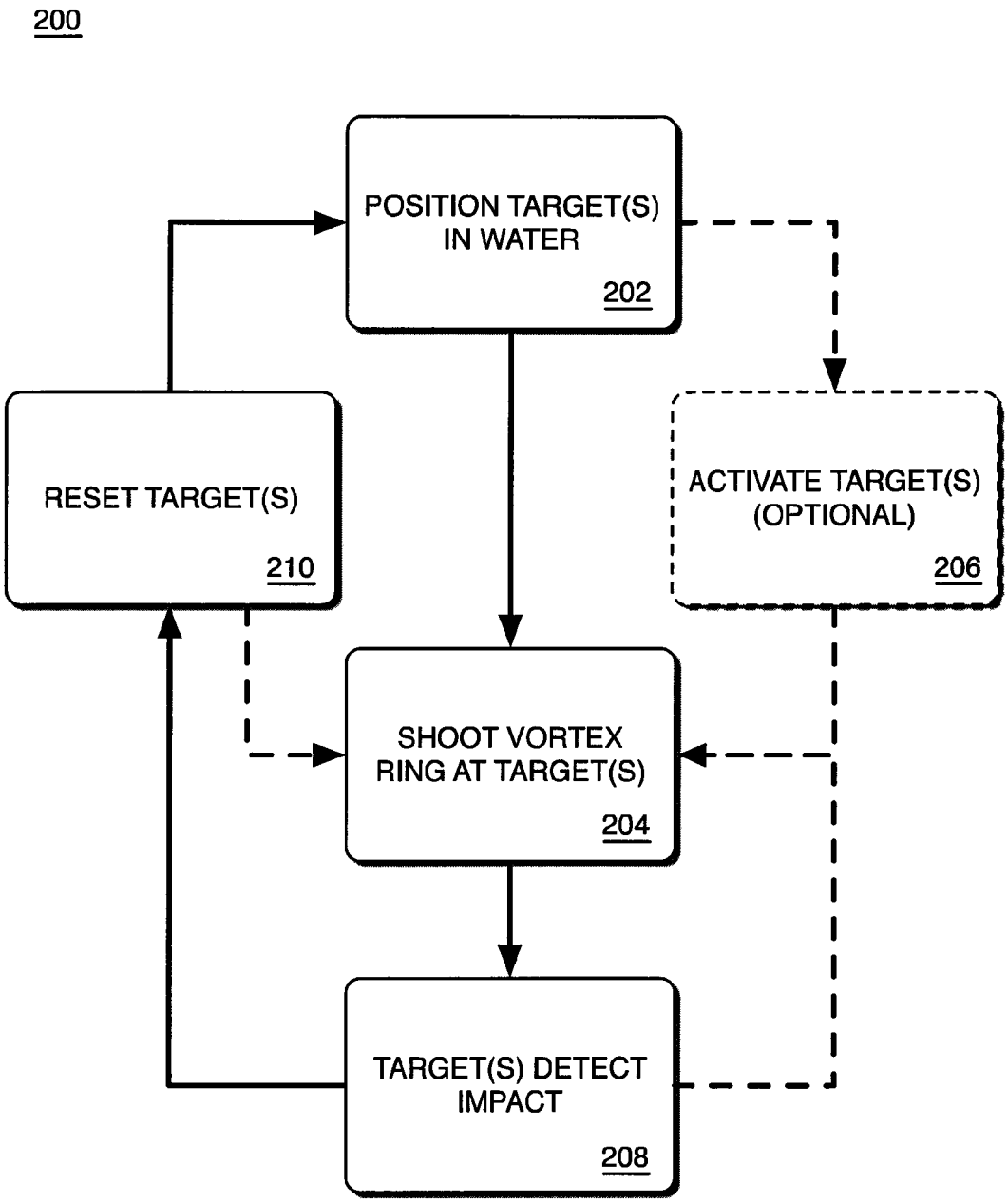
FIG. 2 is a high-level process flow diagram of an underwater target game method according to an embodiment.

FIG. 2 is a high-level process flow of at least a portion of an underwater target game method 200 according to an embodiment. The game begins at step 202 wherein a user positions one or more targets 102 in a body of water, e.g., by placing, tossing, spreading, etc. The flow then proceeds to step 204 wherein the user aims and shoots a vortex ring 104 from a vortex gun 100 toward the one or more targets.

In at least some embodiments, in an optional step 206, the user activates the positioned targets prior to shooting at them. The flow then proceeds to step 204.

The flow then proceeds to step 208 wherein the target 102 detects whether the vortex ring 104 expelled by the gun 100 has impacted the target. If an impact is detected, the target moves to a hit indication state as described above. If no impact is detected, then the target remains in a non-hit indication state. After detection of an impact, the flow proceeds to step 210 and the target is reset to a non-hit indication state. Optionally, more than one hit is necessary to cause the target to require resetting, so the flow proceeds back to step 204 wherein the user shoots at the target again.

In at least some embodiments, the resetting of target 102 occurs either automatically or manually by the user.

The flow then proceeds to either step 202 for repositioning of the target, or (optionally) to step 204 for another shot at the target.

Figure 3:
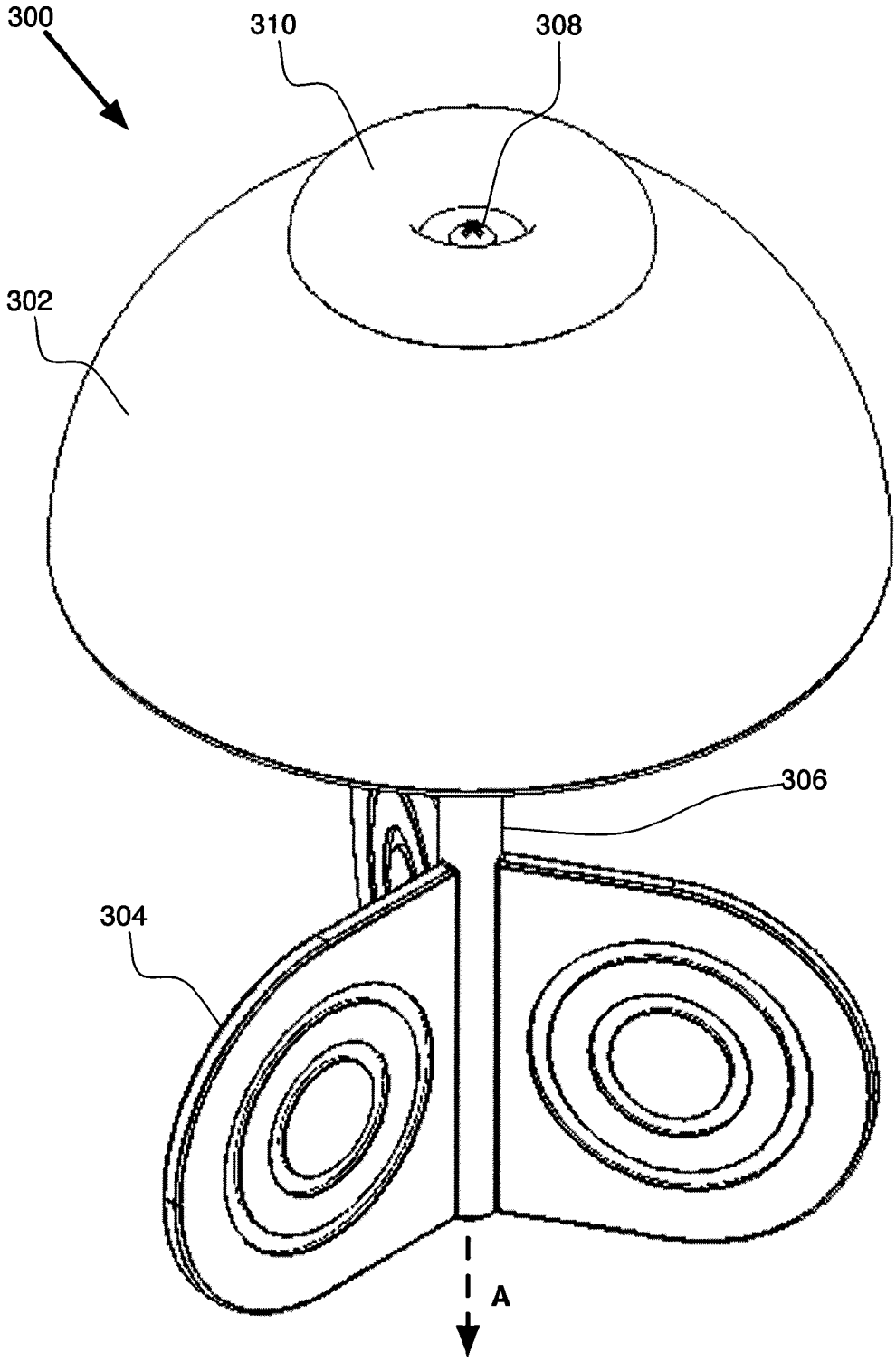
FIG. 3 is a perspective view of a target according to an embodiment.

FIG. 3 is a perspective view of a target 300 according to a submergible target embodiment which is usable in conjunction with vortex gun 100. In at least one embodiment, target 300 is a submergible target configured to capture bubbles or gas released as a result of the impact of a vortex ring on a portion of the target while the target is submerged within a body of water. As a result of the capture of a predetermined volume of released gas by target 300, the buoyancy of the target is increased causing the target to rise in the body of water toward the surface of the water. Target 300 is also referred to as a submergible, bubble capture target.

Target 300 comprises a body 302 coupled with three target panels 304 via a shaft 306. Body 302 is a hemispherically-shaped shell having a hollow interior and an opening on the lower face of the hemisphere. Body 302, in use, resembles an inverted bowl shape having shaft 306 extending downward out of the axial center of the bowl concavity. In at least some embodiments, shaft 306 is affixed to bowl 302 by a threaded fastener 308 inserted through the body from the outside and engaging a threaded receptacle in the shaft inside the body. In at least some other embodiments, different fasteners and methods of coupling shaft 306 and body 302 are usable and within the scope of the present embodiments.

In at least some embodiments, body 302 is triangular, rectangular, hexagonal, octagonal, or another polygonal or ellipsoid-shape in cross-section.

Target projections 304 are flat, rounded panels radially extending from shaft 306 along an axis 'A' of the shaft. Projections 304 (also referred to as panels or surfaces) interface with shaft 306 along a substantially straight edge of the projection. The three panels 304 are evenly, circumferentially spaced around shaft 306. In at least some embodiments, there may be greater or lesser number of panels 304 coupled with shaft 306. In at least some other embodiments, panels 304 and shaft 306 may be integrally formed as a single unit.

In at least some embodiments, body 302, shaft 306 and panels 304 may be formed of plastic, e.g., injection-molded plastic, metal, or other materials. In at least some embodiments, panels 304 are curvilinear-shaped. In at least some embodiments, panels 304 are formed of flexible material which is sufficiently rigid to disrupt an impacting vortex ring.

Body 302 also comprises a ring-shaped protrusion 310 at the top of the body distal from the cavity opening. In at least some embodiments, protrusion 310 comprises a hollow, sealed air-filled region to increase the buoyancy of the top of target 300 such that when the target is placed into a body of water, body 302 orients to be above panels 304. In at least some other embodiments, protrusion 310 comprises a material having a lesser density than body 302 in order to orient the target. In still further embodiments, ring-shaped protrusion 310 is integrated into body 302 or positioned within body 302. In at least some embodiments, protrusion 310 is omitted from target 300.

In at least some embodiments, panels 304 extend radially away from shaft 306 by a distance less than the radius of body 302 at the open edge. In at least some embodiments, panels 304 radially extend from shaft 306 by a distance greater than the maximum radius of body 302. In at least some embodiments, panels 304 are removably attached to shaft 306.

In use, target 300 is at least partially inverted with respect to the FIG. 3 depiction allowing air trapped within the concavity of body 302 to be replaced with liquid, i.e., water from the body of water. Replacement of the trapped air with water allows target 300 to sink to the bottom of the body of water. Target 300 sinks only partially to the bottom of the body of water if only a portion of the trapped air is replaced.

A vortex ring such as vortex ring 104 (FIG. 1) impacting panel 304 is disrupted and releases the gas entrained in and traveling with the ring. Release of the gas allows the gas to rise toward the surface of the body of water. Because body 302 extends beyond the extent of panel 304, the body captures at least a portion of the released gas within the concavity of the body. Capture of gas within the concavity causes target 300 to be more buoyant than without the captured gas. After sufficient gas, i.e., a predetermined volume of gas, is captured within body 302, target 300 rises toward the surface of the body of water.

In at least some embodiments, body 302 further comprises an air release mechanism, e.g., a valve or small hole, in an upper surface to enable release, either intermittently or continuously, of trapped air from within body 302 to obviate the need to invert target 300.

In at least some other embodiments, target 300 further comprises a flag or other vertically extending marker on an upper portion of body 302 which, when target 300 rises a sufficient distance from the initial placement, protrudes through the surface of the water to indicate completion of the game with respect to a particular target.

Figure 4:
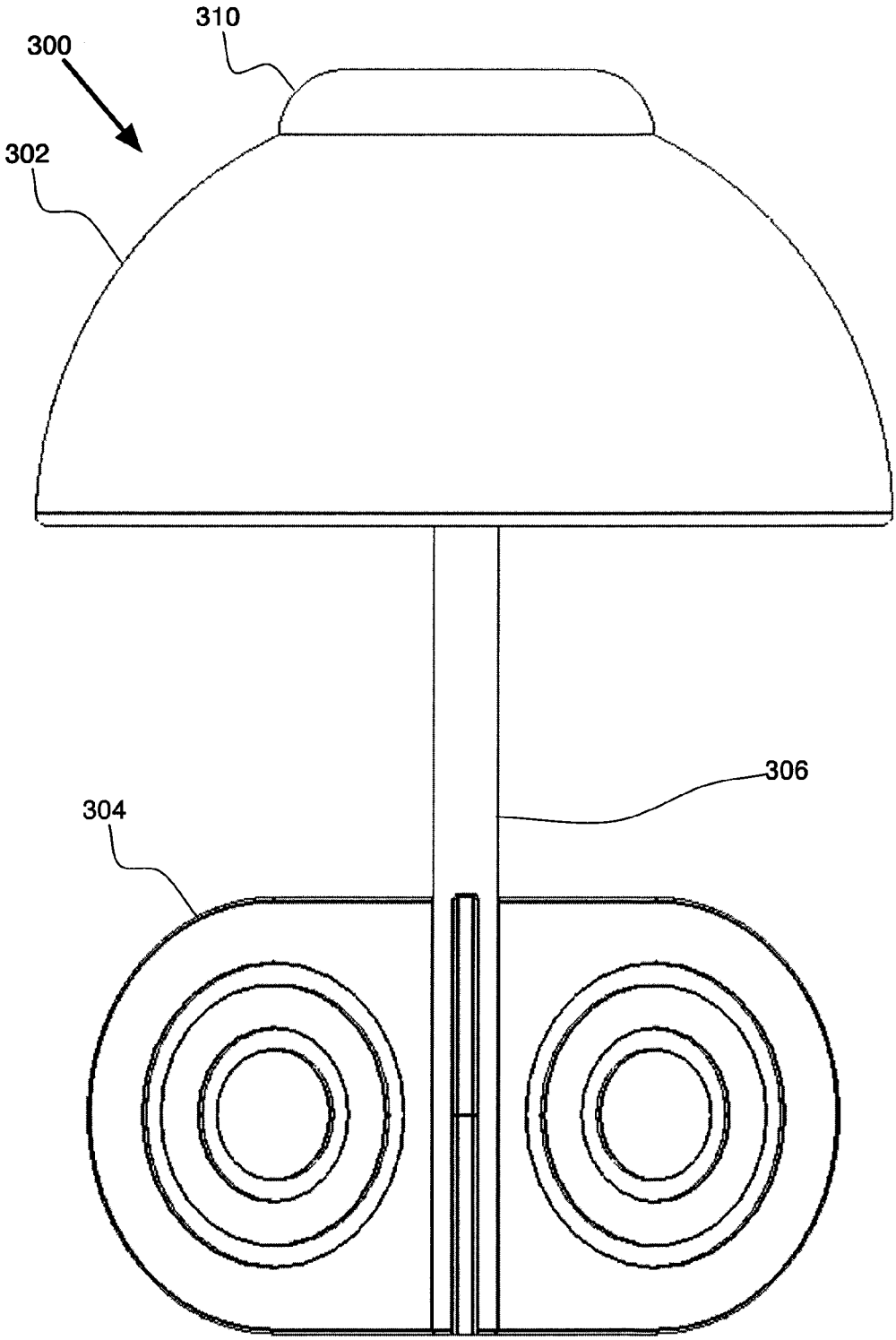
FIG. 4 is a side view of the FIG. 3 embodiment.

FIG. 4 is a side view of target 300 of the FIG. 3 embodiment.

Figure 5:
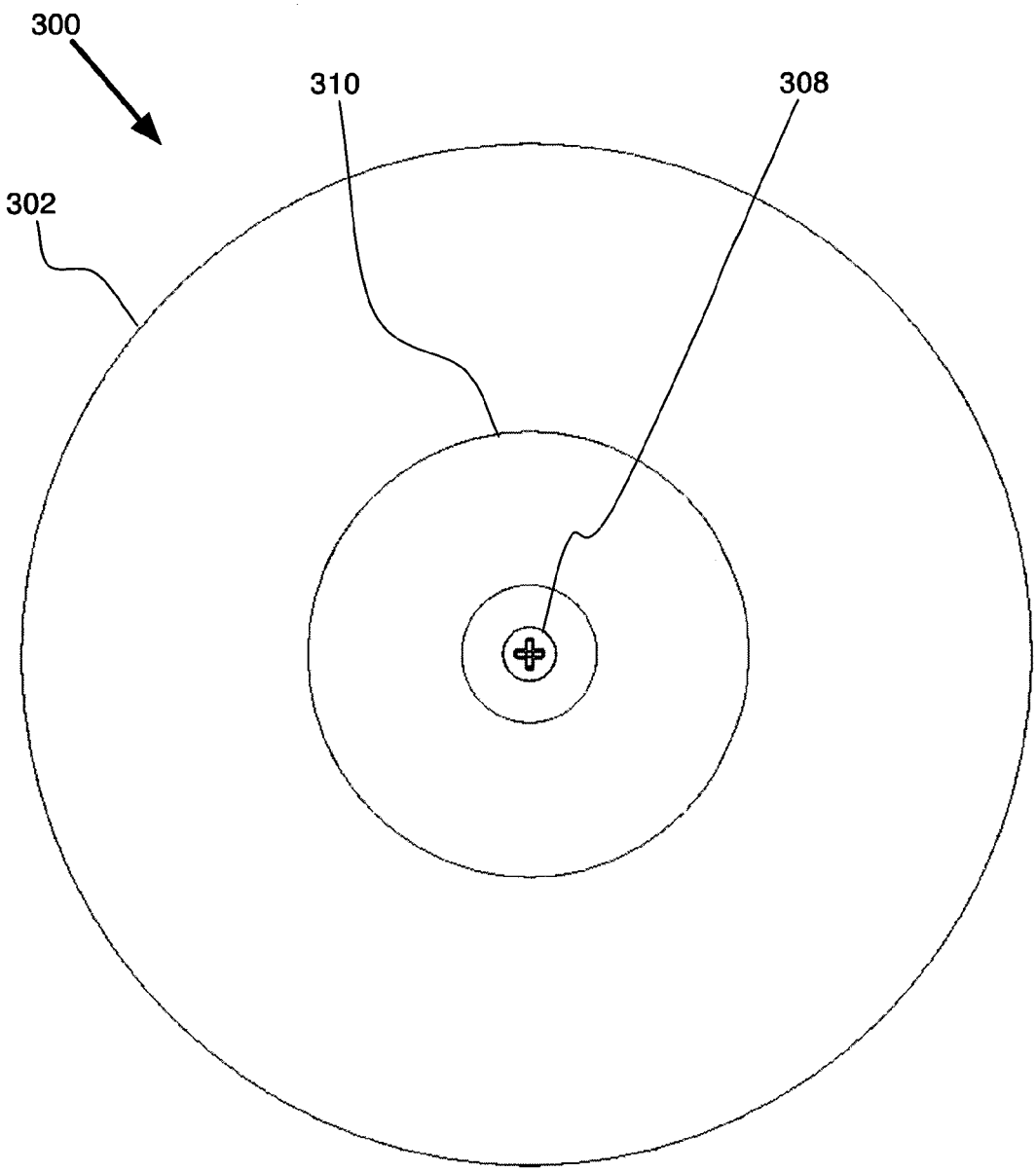
FIG. 5 is a top view of the FIG. 3 embodiment.

FIG. 5 is a top view of target 300 according to the FIG. 3 embodiment.

Figure 6:
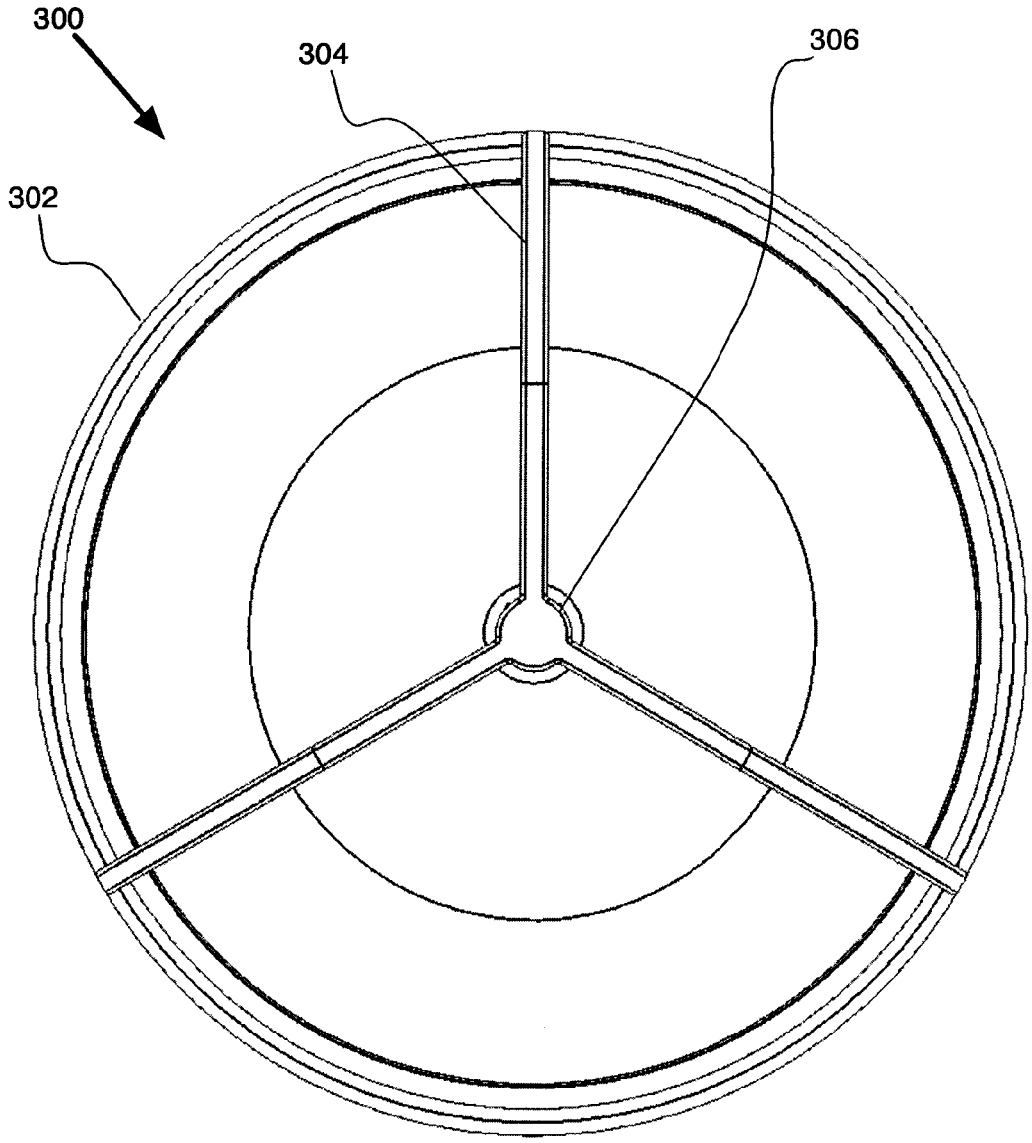
FIG. 6 is a bottom view of the FIG. 3 embodiment.

FIG. 6 is a bottom view of target 300 according to the FIG. 3 embodiment.

Figure 7:
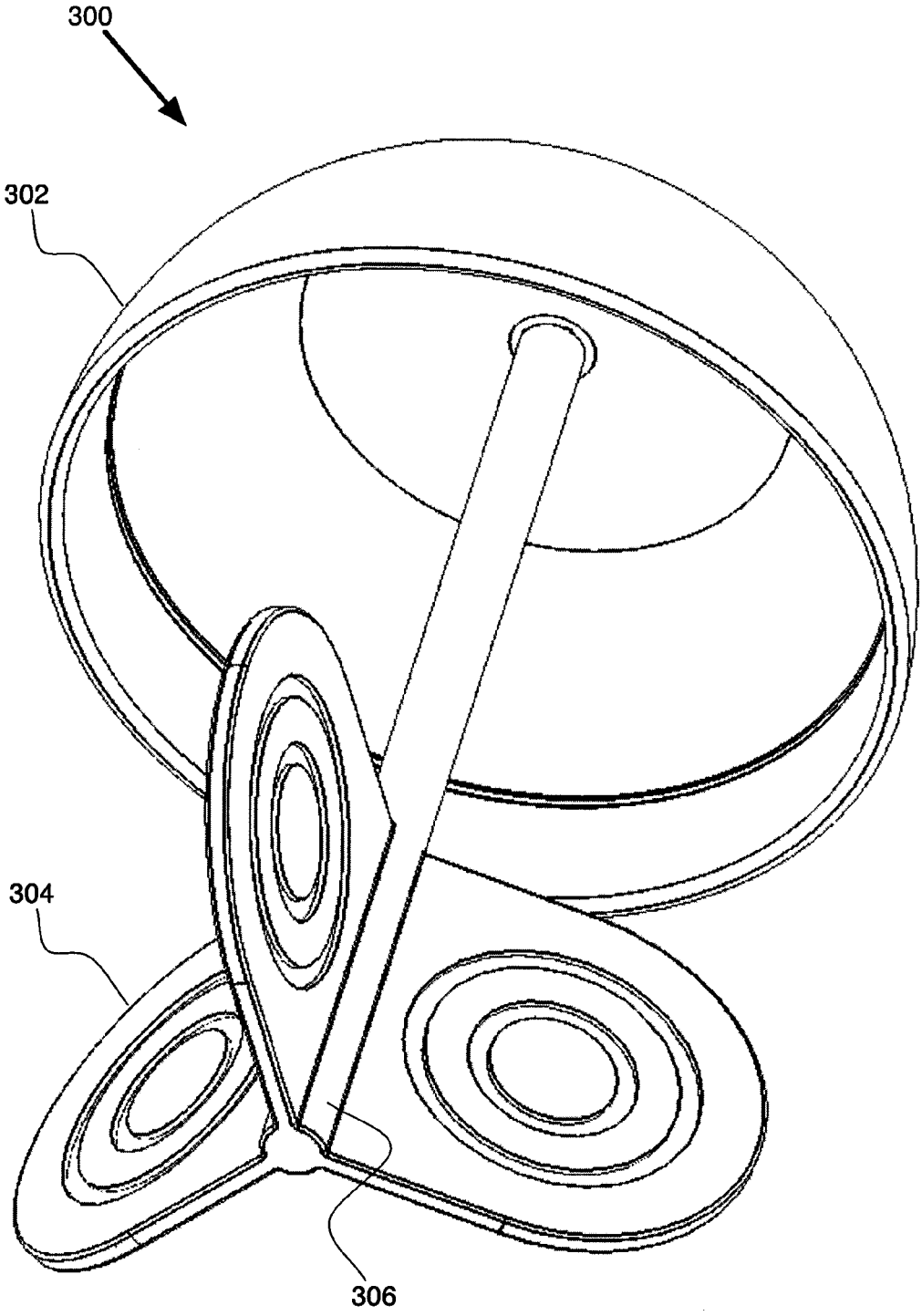
FIG. 7 is another perspective view showing the underside of the FIG. 3 embodiment.

FIG. 7 is a bottom perspective view of target 300 according to the FIG. 3 embodiment.

Figure 8:
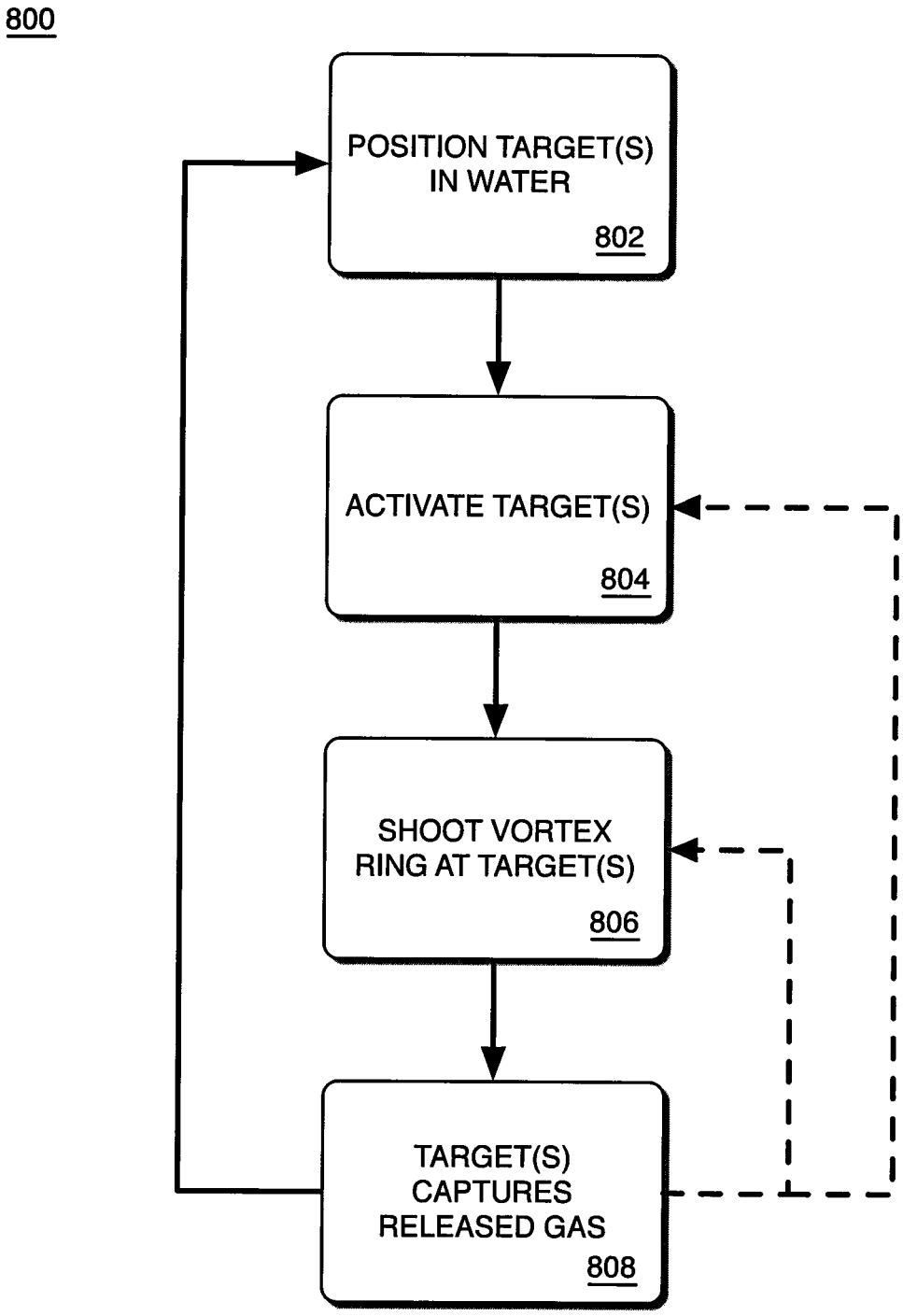
FIG. 8 is a high-level process flow diagram of an underwater target game method according to a submergible, bubble capture embodiment.

FIG. 8 is a high-level process flow of at least a portion of an underwater target game method 800 using the submergible, bubble capture target 300 similar to the underwater target game method 200 (FIG. 2). The game begins at step 802 wherein a user positions one or more targets 300 in a body of water. The flow then proceeds to step 804 wherein the user activates the positioned target(s) by at least partially inverting the target in order to remove trapped air from within body 302 and thereby enable the target to sink. In at least some embodiments, the user completely inverts target 300 to remove trapped air from within body 302. In at least some embodiments, the user removes at least a portion of trapped air from within body 302 sufficient to enable target 300 to sink to the bottom of the body of water. In still further embodiments, the user removes only a sufficient portion of trapped air from within body 302 to enable target 300 to sink below the surface of the water and remain suspended above the bottom of the body of water.

The flow then proceeds to step 806 wherein the user aims and shoots a vortex ring 104 from a vortex gun 100 toward the one or more targets.

The flow then proceeds to step 808 wherein target 300 captures at least a portion of gas released from vortex ring 104 by impact of the ring with a portion of target 300 below body 302, e.g., one of panels 304. After one or more impacts of rings 104 to the target, sufficient gas may be captured in the body to change the buoyancy of the target and cause the target to rise in the water, thereby transitioning the target to a hit indication state. If no impact occurs, i.e., the player's shot misses target 300, then the target remains in a non-hit indication state, i.e., on the bottom of the body of water or floating below the surface of the water. Additionally, in at least some embodiments, an impact of a ring 104 may impact target 300 without causing capture of released gas, for example, by impact of the ring with an outer, upper portion of body 302. After collection of sufficient gas by body 302 and surfacing of at least a portion of target 300 indicating one or more hits by a player shooting at the target, the flow proceeds to step 802 and the target is reset to a non-hit indication state.

In at least some embodiments, the flow proceeds to step 804 (via the dashed line of FIG. 8) without re-positioning target 300. A user upends or resets target 300 to release accumulated gas to make the target ready for another round of play. In at least some embodiments, the release of accumulated gas occurs automatically, such as by the opening of a valve in response to the surfacing of the target, or by the continuous leaking of the accumulated gas through a small hole in the body.

One or more players can take turns positioning target 300 in a body of water and one or the other shooting vortex rings 104 at the target until the target collects sufficient gas released from the ring impact(s) to cause the target to surface. In at least some embodiments, a timer may be used or two players may shoot at separate targets in a race against each other to further heighten the sense of excitement of the game.

In at least some embodiments, a first player positions one or more targets 300 in a body of water and the second player shoots at the positioned targets. In at least some embodiments, the first player and the second player are the same player, i.e., a single player is positioning and shooting at the target(s). In at least some embodiments, the first player and the second player are different players. In at least some embodiments, there are two or more players using at least one gun and one target.

Figure 9:
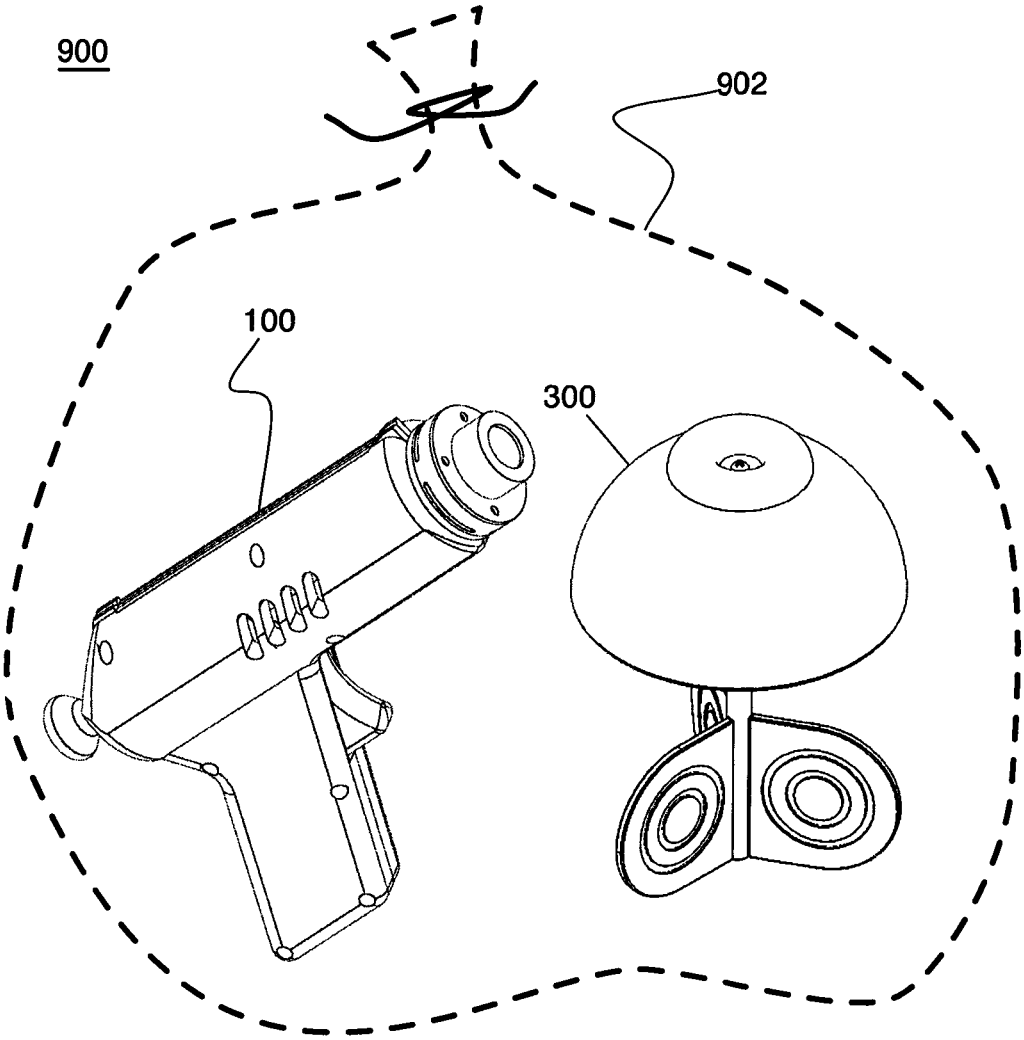
FIG. 9 is a side cut-away view of an underwater target game kit according to an embodiment.

FIG. 9 is a side cut-away view of an underwater target game kit 900 according to an embodiment. Game kit 900 (alternatively referred to as a game package) comprises a bag 902 into which are placed at least one vortex gun 100 and at least one target 300. In at least some embodiments, there may be greater or lesser number of guns and targets in bag 902. In at least some embodiments, bag 902 is a mesh or string bag allowing moisture which may have collected on/in the gun or the target to drain off the items. In at least some embodiments, bag 902 may be replaced by a box or other packaging for storing and/or displaying the contents, e.g., for sale. In at least some other embodiments, bag 902 may be replaced by a vented box or some other porous packaging.

It will be readily seen by one of ordinary skill in the art that the disclosed embodiments fulfill one or more of the advantages set forth above. After reading the foregoing specification, one of ordinary skill will be able to affect various changes, substitutions of equivalents and various other embodiments as broadly disclosed herein. It is therefore intended that the protection granted hereon be limited only by the definition contained in the appended claims and equivalents thereof.

What is claimed is:

1. A target for use in an underwater target game, the target comprising:

a body with a cavity for capturing a volume of gas; and one or more target surfaces, separate from the body, positioned to release gas from an impacting vortex ring for capture by the body, wherein the target is configured to transition from a neutral buoyant or non-buoyant state to a hit indication state responsive to impact of the vortex ring; and a protrusion on a surface of the body facing away from the one or more target surfaces, the protrusion comprises a sealed air-filled region.

2. The target as claimed in claim 1, the surfaces extending from an axial center of the body.

3. The target as claimed in claim 1, the surfaces having a face perpendicular to the cavity opening of the body.

4. The target as claimed in claim 1, each surface comprising a flat panel.

5. The target as claimed in claim 1, further comprising:

a shaft extending from the body and connecting the one or more target surfaces to the body.

6. The target as claimed in claim 5, wherein the shaft extends from within the interior of the cavity portion of the body to connect to the one or more target surfaces.

7. The target as claimed in claim 1, the body having a hemispherical shape.

8. The target as claimed in claim 1, wherein said protrusion has a density less than that of water such that at least a portion of the body remains above the target surfaces after positioning the target in a body of water.

9. The target as claimed in claim 1, the target having a net density distribution sufficient to maintain at least a portion of the body above the target surfaces after positioning the target in a body of water.

10. The target as claimed in claim 1, the body sized to retain sufficient gas released by one or more impacting vortex rings to cause the target to become positively buoyant in water.

11. A game package comprising:

a container comprising:

a vortex ring gun, the vortex ring gun configured to generate one or more vortex rings, each vortex ring of the one or more vortex rings comprising a mixture of a buoyant fluid and a non-buoyant fluid, the one or more vortex rings configured to travel substantially perpendicular to a direction of buoyancy of the buoyant fluid; and a target comprising:

a body with a cavity for capturing a volume of the buoyant fluid, wherein the body is non-buoyant or neutral buoyant prior to capturing the volume of the buoyant fluid; and one or more target surfaces, separate from the body, positioned to release the buoyant fluid from an impacting vortex ring for capture by the body, the target being configured to transition to a hit indication state responsive to impact of the vortex ring.

12. The game package as claimed in claim 11, the container is at least one of a box or a bag.

13. The game package as claimed in claim 12, the container is a mesh bag.

14. The game package as claimed in claim 11, the container is at least one of vented or porous.

15. An underwater target game comprising:

a target positionable within a body of water, said target configured to transition to a hit indication state in response to impact of a vortex ring, wherein said target comprises:

a body configured to capture a volume of buoyant fluid;

a shaft, a first end of the shaft connected to the body; and at least one target surface positioned to release buoyant fluid from an impacting vortex ring, wherein the at least one target surface is connected to a second end of the shaft opposite the first end; and a vortex ring producing gun, said gun configured to generate a vortex ring comprising a mixture of the buoyant fluid and a non-buoyant fluid within the body of water, the vortex ring configured to travel substantially parallel to a top surface of the body of water.

* * * * *